US006758184B1

(12) United States Patent
Lee et al.

(10) Patent No.: US 6,758,184 B1
(45) Date of Patent: Jul. 6, 2004

(54) METHOD AND APPARATUS FOR REDUCING OSCILLATORY CAMSHAFT TORQUE IN AN INTERNAL COMBUSTION ENGINE

(75) Inventors: Jongmin Lee, Pittsford, NY (US); John Krieg, Spencerport, NY (US); Thomas H. Fischer, Rochester, NY (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 10/454,895

(22) Filed: Jun. 5, 2003

(51) Int. Cl.[7] ..... F01M 1/00
(52) U.S. Cl. ..... 123/196 R; 123/198 C
(58) Field of Search ..... 123/196 R, 198 C; 417/470

(56) References Cited

U.S. PATENT DOCUMENTS 6,937,806 8/1999 Lyko et al.
6,543,400 B1 4/2003 Urckfitz et al.

*Primary Examiner*—Noah P. Kamen
(74) *Attorney, Agent, or Firm*—Patrick M. Griffin

(57) ABSTRACT

A peristaltic piston pump driven by a dedicated pump cam disposed on a camshaft of an engine. A plurality of valve-opening cams are also disposed along the camshaft. The pump cam has a plurality of lobes equal in number to the number of valve cams and each pump lobe is disposed at 180° from a valve cam lobe such that the camshaft valve torque and secondary oil pump camshaft torque partially cancel, reducing overall camshaft torque oscillation. The pump includes a lost-motion shuttle and spring to permit continuous response of the pump to the cam.

6 Claims, 6 Drawing Sheets

METHOD AND APPARATUS FOR REDUCING OSCILLATORY CAMSHAFT TORQUE IN AN INTERNAL COMBUSTION ENGINE

TECHNICAL FIELD

The present invention relates to oil pumps for internal combustion engines; more particularly, to a secondary oil pump for boosting oil pressure when the output pressure of the primary engine oil pump is low; and most particularly, to a secondary oil pump driven by a cam on the engine's camshaft wherein pump-actuating cam lobes are out of phase with valve actuating cam lobes.

BACKGROUND OF THE INVENTION

Oil pumps for internal combustion engines are well known. A primary engine oil pump may be, for example, a mechanically-driven positive-displacement gear pump fed from the engine's crankcase and driven by rotation of the engine's camshaft or crankshaft. Oil pump output flow is typically a direct function of the rotary speed of the engine. Because of engineered oil leaks between lubricated components in the oil pathway, and because of wear in those components during the lifetime of the engine, oil pressure also may be relatively low during periods of low engine speeds such as at idle and increases only as engine speed increases. Also, as engine temperature increases, oil viscosity decreases in known fashion, causing increased flow through the leaks and consequent reduced line pressure. In addition to insufficient engine lubrication, low oil pressure can result in slow or faulty actuation of oil-driven auxiliary engine devices, for example, camshaft phasers and variable valve actuators.

It is known to use an electrically-driven auxiliary pump to increase oil pressure for oil being supplied to a variable valve actuation mechanism.

What is needed is an inexpensive, reliable, mechanical means for maintaining a minimum oil pressure and flow in an internal combustion engine.

Another problem in an internal combustion engine is the amplitude of torque oscillation of the engine's camshaft(s). During operation of the engine, while each valve is closed, the follower for the associated cam rides on the base circle portion of the cam. To open the valve, the follower rides up the front side of the eccentric lobe. The resistance caused by the opposing force of the valve return spring places a torque on the camshaft in a direction counter to the rotational direction of the camshaft. After the peak of the lobe is passed and the valve is closing, the direction of torque is reversed as the follower rides down the back side of the lobe, urged by the force of the valve spring. The camshaft is thus subjected to relatively violent torque reversals for each engine valve actuation resulting in oil pressure fluctuation (especially within the camshaft phaser), undesirable vibration, wear, and energy loss in the form of heat.

What is needed is a means for reducing the amplitude of torque oscillation of an engine camshaft.

It is a principal object of the present invention to reduce the amplitude of torque oscillation of an engine camshaft.

SUMMARY OF THE INVENTION

Briefly described, a secondary oil supply pump augments oil flow from a primary supply pump in an internal combustion engine. The secondary pump is a peristaltic piston pump driven by a dedicated cam disposed on a camshaft of the engine. Preferably, the pump cam is formed having a plurality of lobes equal in number to the number of valves actuated by the camshaft, and further, that each pump cam lobe is disposed at 180° from a valve cam lobe such that the torque exerted by the closing valve assists in providing a pumping pulse to the secondary oil pump; and the torque exerted by termination of the pumping pulse assists in opening the next valve. In this way, the net amplitude of the camshaft torque oscillation is substantially reduced. A three-way valve responsive to inline pressure and, preferably, an engine control module governs the flow of oil either around the secondary pump at acceptably high primary pump pressures or through the secondary pump when primary pressure is unacceptably low.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
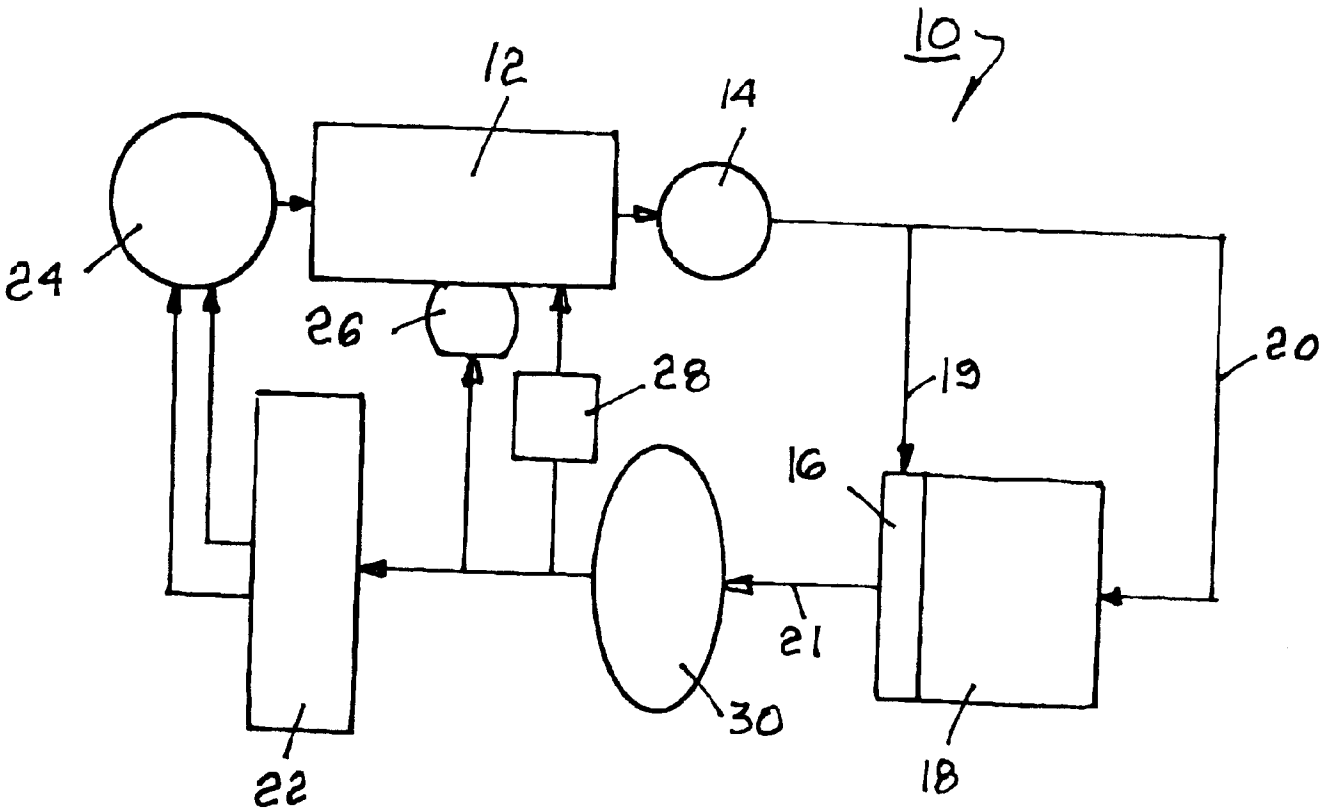
FIG. 1 is a schematic diagram of an oil circulation system for an internal combustion engine in accordance with the invention.

Referring to FIG. 1, in a schematic diagram for an oil circulation system 10 for an internal combustion engine, an oil sump 12, such as an engine crankcase, supplies oil to a conventional primary oil pump 14. Pump 14 supplies oil under pressure to the rest of the system via a three-way valve 16 disposed at the exit of a secondary oil supply (booster) pump 18 in accordance with the invention. Oil from primary pump 14 may flow either around or through secondary pump 18 via lines 19,20, as selected by valve 16 in accordance with conditions described below.

Oil flows from valve 16 via line 21 to other lubricated elements, such as a control valve 22 for controlling the action of camshaft phaser 24, a variable valve actuation mechanism 26, and general lubrication of engine 28, via an optional oil accumulation reservoir 30. All lubrication paths lead eventually back to sump 12.

Figure 2:
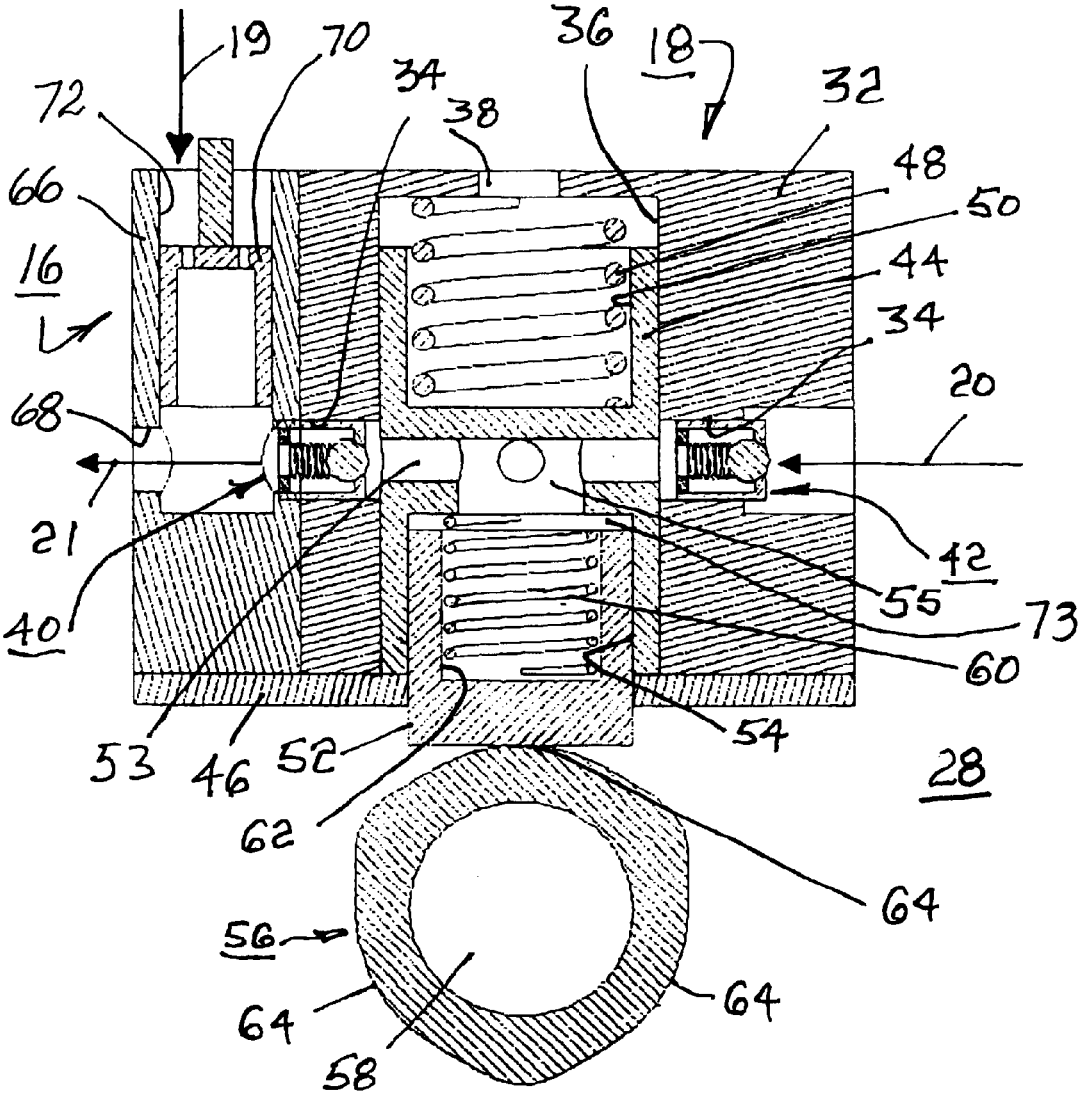
FIG. 2 is an elevational cross-sectional view of a secondary oil supply pump actuated by a camshaft cam in accordance with the invention, showing the pump on a base circle portion of the cam.

Referring to FIG. 2, peristaltic secondary oil pump 18 includes a pump body 32 having a transverse bore 34 and a blind bore 36 orthogonal to transverse bore 34. Blind bore 36 preferably is provided with a vent opening 38. Within transverse bore 34 on opposite sides of blind bore 36 are disposed first and second check valves 40,42 for permitting oil flow only in the direction from line 20 to line 21 and not the reverse. A lost-motion shuttle 44 having a length shorter than the depth of blind bore 36 is slidingly disposed in blind bore 36 and is captured therein by plate 46. A lost-motion spring 48 is disposed in compression in a second well 50 in shuttle 44 to bias shuttle 44 toward plate 46. A cam follower 52 is slidingly disposed in a first well 54 in shuttle 44 and extends through an opening in plate 46 for engaging a cam 56 fixedly disposed on a camshaft 58 of engine 28. Of course, cam follower 52 may be a roller follower as is well known in the art. A cam follower return spring 60 is disposed in compression in a third well 62 in cam follower 52 for biasing the cam follower into continuous contact with cam 56. In FIG. 2, cam follower 52 is in contact with a base circle portion 64 of cam 56. A transverse bore 53 in shuttle 44 provides an oil flow path between first and second check valves 40,42. Shuttle transverse bore 53 further communicates with third well 62 via an axial passage 55 in shuttle 44.

Figure 3:
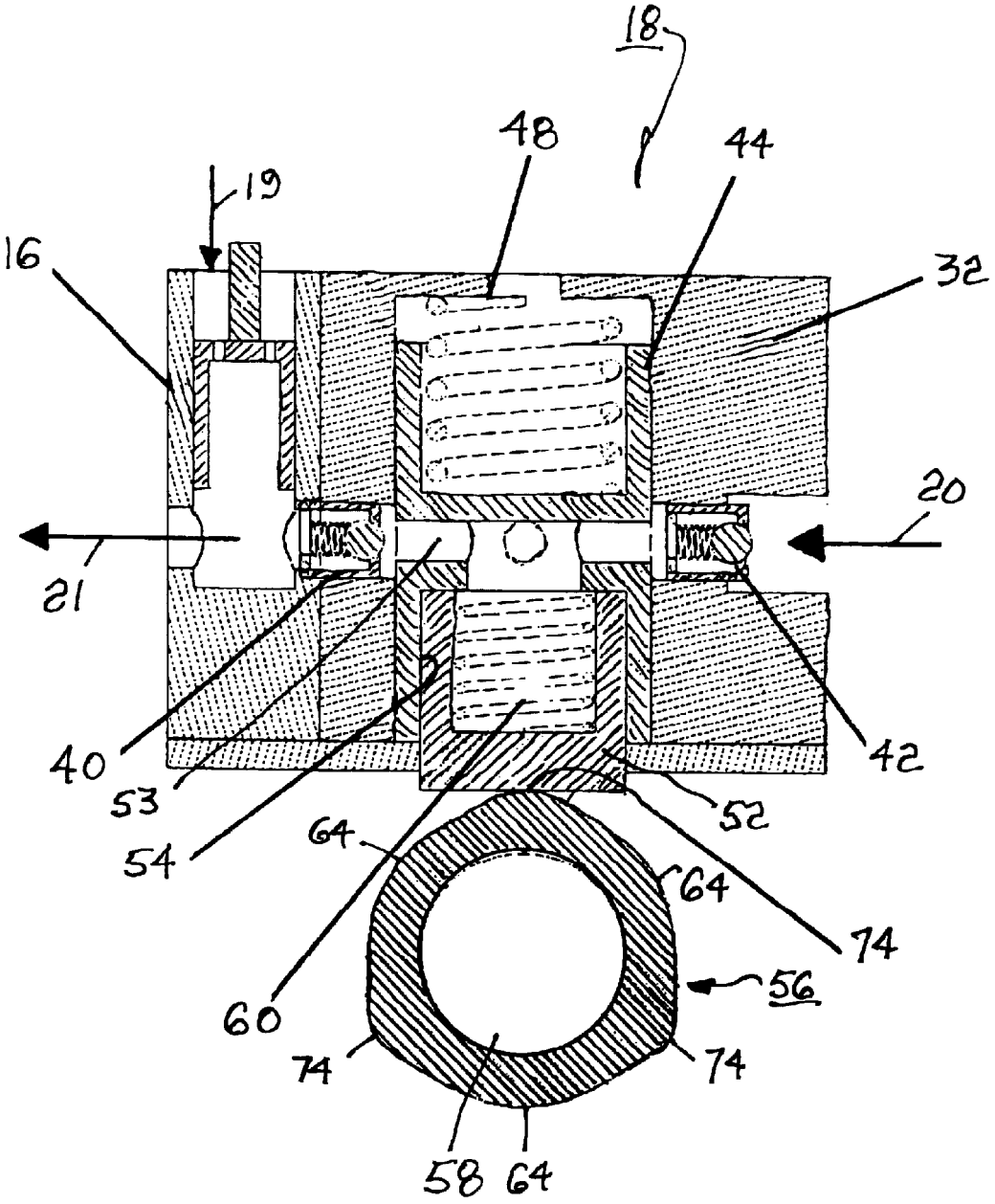
FIG. 3 is an elevational cross-sectional view like that shown in FIG. 2, showing the pump in cam-actuated mode.
Figure 4:
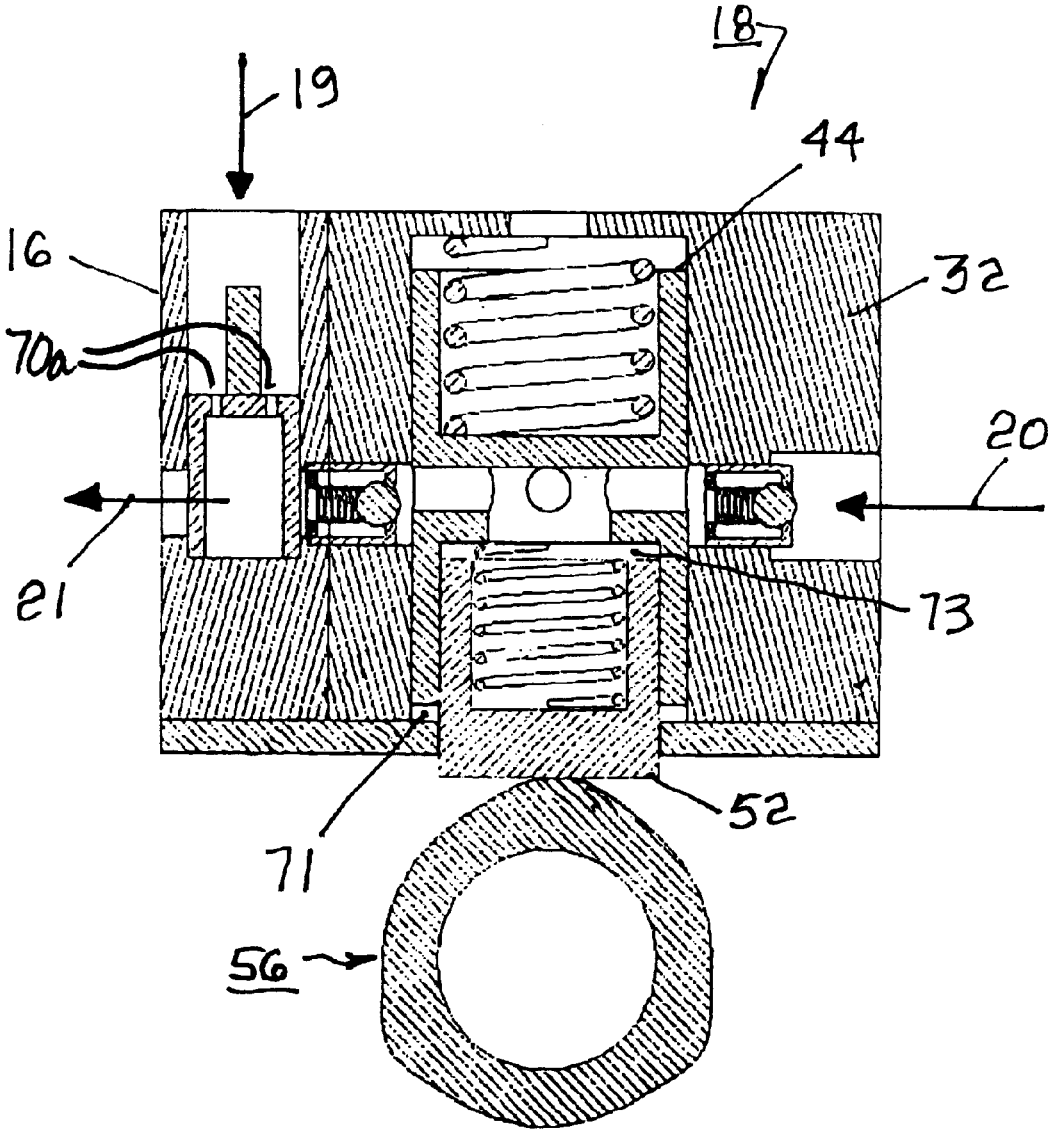
FIG. 4 is an elevational cross-sectional view like that shown in FIGS. 2 and 3, showing the pump in non-pumping lost-motion mode.

Three-way valve 16 includes a valve body 66 mounted for convenience onto pump body 32. A first bore 68 is provided preferably coaxial with transverse bore 34 in body 32 for flow of oil through body 66. Of course, valve 16 may be mounted apart from pump 18 as desired and connected thereto via an additional line. A spool 70, controllable as by a conventional solenoid or stepper motor or other means (none shown), is slidingly disposed in a second bore 72 in valve body 66. In a first control position, when oil pressure output from primary pump 14 is unacceptably low, spool 70 permits oil flow through pump 18, as shown in FIGS. 2 and 3. In a second control position, when oil pressure output from primary pump 14 is acceptably high, spool 70 permits oil flow only from line 19 through orifices 70a and prevents oil flow through pump 18, as shown in FIG. 4.

The peristaltic pumping action of pump 18 is as follows. After initial filling, shuttle transverse bore 53 between the check valves, passage 55, and well 62 remain filled with oil at all times. When camshaft 58 causes cam 56 to present a base circle portion 64 to follower 52, spring 60 urges follower 52 away from the bottom of well 54, creating a space 73 and thereby drawing oil from line 20 through check valve 42 to fill space 73, the volume of which represents the per-stroke volume of the pump.

Referring to FIG. 3, when camshaft 58 rotates to cause cam 56 to present an eccentric lobe 74 to follower 52, the follower is urged axially of bore 54, overcoming return spring 60 (but not the stronger lost-motion spring 48), eliminating space 73, and expressing an equal volume of oil from shuttle transverse bore 53 through check valve 40 into line 21. Further rotation of camshaft 58 causes the follower to return to the next base portion circle 64 of cam 56, refilling space 73 in preparation for the next stroke of the pump.

Since the pump must respond continuously to the action of cam 56, whether or not oil is to be pumped into line 21, a lost motion mechanism must be provided. Referring to FIG. 4, when valve 16 is closed to pump 18, oil flow from the pump is deadheaded. Because oil is substantially incompressible, space 73 is not eliminated but rather follower 52 and shuttle 44 are displaced as a unit axially within blind bore 36 by a distance 71 equal to the height of space 73, overcoming lost-motion spring 48. Thus, when flow is shut off, shuttle 44 simply cycles within pump body 32 to follow in lost motion the action of cam 56.

Figure 5:
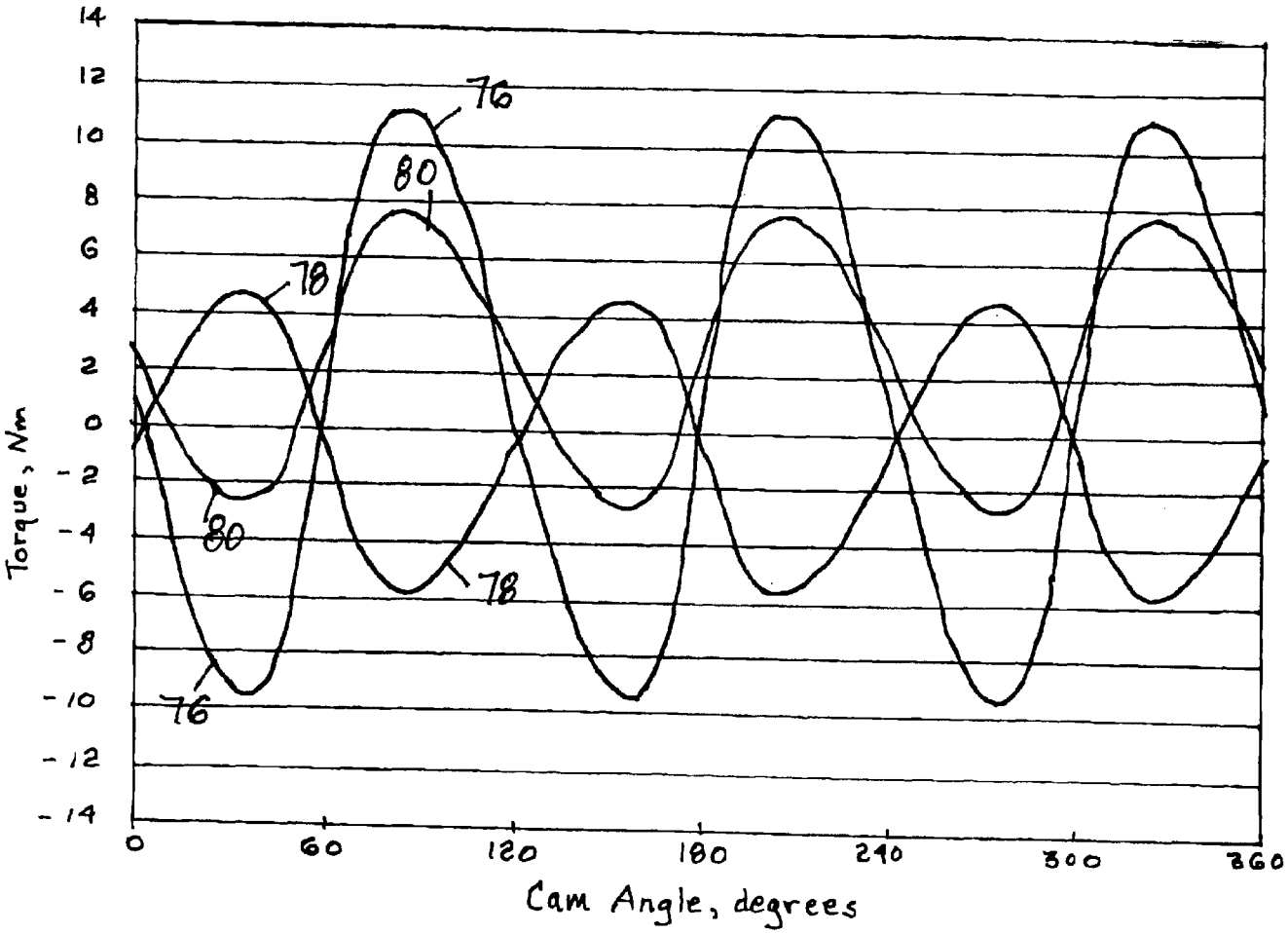
FIG. 5 is a graph of camshaft torque as a function of rotational angle of a camshaft for a three-cylinder application, showing a reduction in camshaft torque oscillation as a result of the invention.
Figure 6:
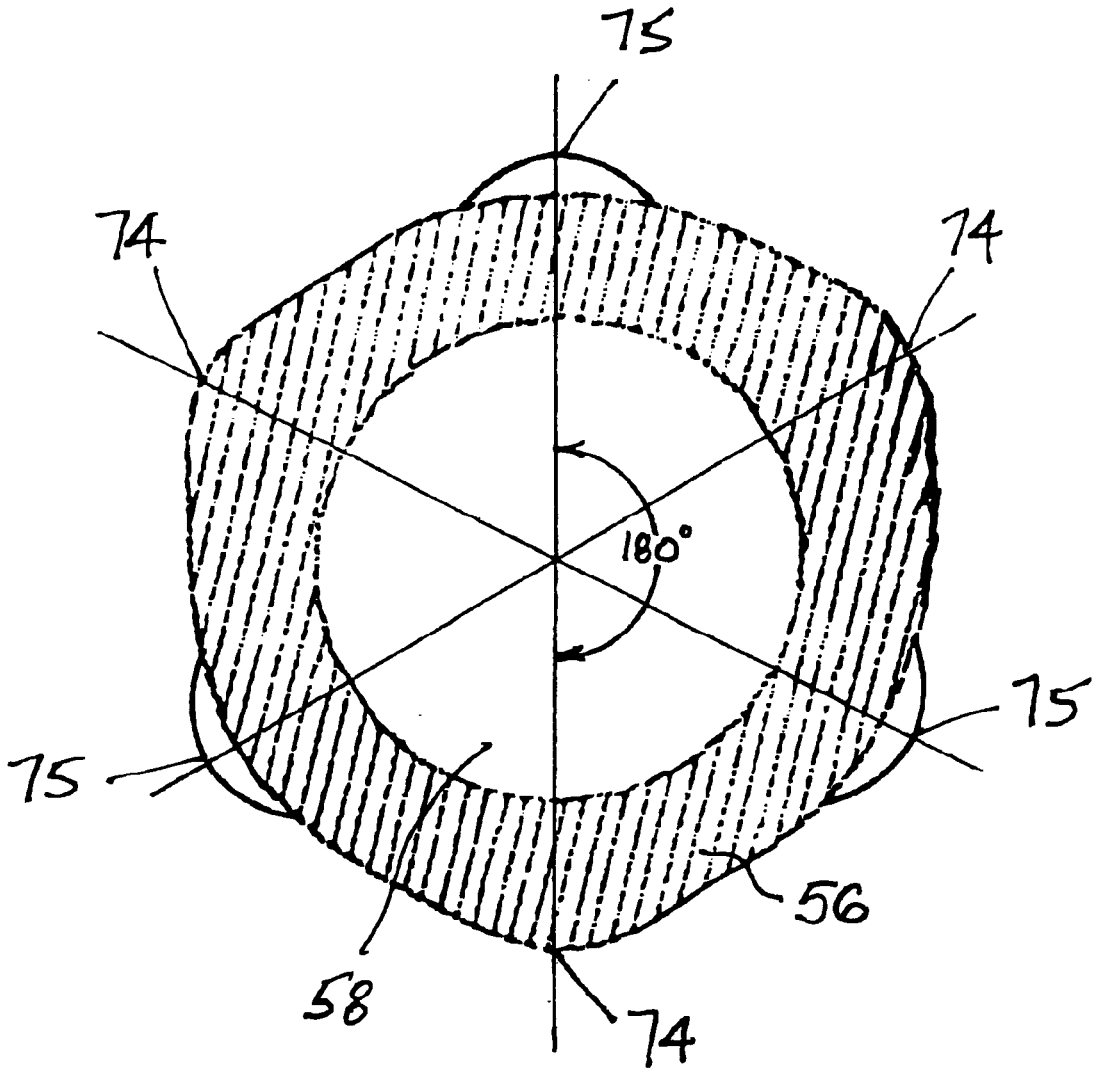
FIG. 6 is an view of a camshaft in accordance with one embodiment of the invention.

Cam 56 is shown in FIGS. 2–4 as having three base circle portion segments 64 and three eccentric lobes 74. Thus one rotation of the camshaft produces three strokes of the pump. Referring to FIGS. 5 and 6, an added advantage of a peristaltic secondary oil pump is shown. Curve 76 represents the torque, both in the direction of camshaft rotation (+) and against the direction of camshaft rotation (−), exerted on camshaft 58 in opening and closing three intake or exhaust valves of a three-cylinder engine, or one bank of a V-6 engine. Curve 78 represents the torque exerted on camshaft 58 by one rotation of cam 56 in actuating the oil pump three times. By angularly orienting cam 56 on camshaft 58 such that the pump-actuating lobes 74 are rotationally interspersed between the valve-actuating lobes 75, and preferably that each lobe 74 is exactly 180° from one of the three valve cam lobes 75 (FIG. 6), the torque resulting from the valve lobes and the pump lobes partially cancel, the net camshaft torque oscillation being represented by curve 80.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. In an internal combustion engine having a peristaltic oil pump actuated by a cam on a camshaft of the engine, the pump-actuating cam having a plurality of pump-actuating lobes, the camshaft being further provided with a plurality of additional cams having individual lobes for actuating associated valves in the engine, the improvement wherein said pump-actuating lobes are spaced angularly about said pump-actuating cam and wherein said valve-opening lobes are angularly interspersed between said pump-actuating lobes.

2. An improvement in accordance with claim 1 wherein each of said valve-opening lobes is angularly equidistant from angularly adjacent pump-actuating lobes.

3. A method for reducing the magnitude of torque oscillation in a valve-actuating camshaft of an internal combustion engine, the camshaft supporting a plurality of valve-actuating cams, each valve-actuating cam having an individual lobe for actuating an engine valve and the valve-actuating lobes being angularly spaced around the camshaft, comprising the steps of:

a) providing a peristaltic oil pump actuated by a cam on said camshaft, said pump-actuating cam having a plurality of pump-actuating lobes equal in number to the number of valve-actuating lobes and being angularly spaced around said camshaft; and b) orienting said pump-actuating cam on said camshaft such that said pump-actuating lobes are angularly interspersed between said valve-actuating lobes.

4. A method in accordance with claim 3 wherein each of said valve-actuating lobes is angularly equidistant from angularly adjacent pump-actuating lobes.

5. An internal combustion engine, comprising:

a) a camshaft;

b) a first cam disposed on said camshaft for actuating a peristaltic oil pump, said pump-actuating cam having a plurality of pump-actuating lobes;

c) a plurality of additional cams disposed on said camshaft and having individual lobes for actuating associated valves in said engine, said additional cams being equal in number to the number of pump-actuating lobes, wherein said pump-actuating lobes are evenly spaced angularly about said pump-actuating cam and wherein said valve-actuating lobes are angularly interspersed between said pump-actuating lobes, so that torque imposed on said camshaft by actuation of said valves is at least partially opposed by torque imposed by actuation of said pump, such that net torque on said camshaft is diminished.

6. An engine in accordance with claim 5 wherein each of said valve-actuating lobes is angularly equidistant from angularly adjacent pump-actuating lobes.

* * * * *